US005144825A

United States Patent [19]

Burg et al.

[11] Patent Number: 5,144,825

[45] Date of Patent: Sep. 8, 1992

[54] ELEVATED TEMPERATURE ENVELOPE FORMING

[75] Inventors: Bruce M. Burg, Louisville, Colo.; David H. Gane; Robert M. Starowski, both of Seattle, Wash.

[73] Assignee: The Boeing Company, Seattle, Wash.

[21] Appl. No.: 589,058

[22] Filed: Sep. 27, 1990

[51] Int. Cl.[5] ..... B21D 26/02

[52] U.S. Cl. ..... 72/60; 72/63; 29/889.7; 29/421.1

[58] Field of Search ..... 29/889.7, 889.71, 889.72, 29/421.1; 72/60, 63

[56] References Cited

U.S. PATENT DOCUMENTS

| | | | |
|---|---|---|---|
| 2,728,317 | 12/1955 | Clevenger et al. | 72/60 |
| 2,825,794 | 3/1958 | Stalker | 29/889.72 |
| 3,263,319 | 8/1966 | Tifft et al. | 29/423 |
| 3,340,101 | 9/1967 | Fields, Jr. et al. | 72/60 |
| 3,566,661 | 3/1971 | McCafferty et al. | 72/365 |
| 3,584,368 | 6/1971 | Sargent, Jr. | 29/424 |
| 3,722,068 | 3/1973 | Manchester et al. | 29/423 |
| 3,974,673 | 8/1976 | Fosness et al. | 72/38 |
| 3,979,815 | 9/1976 | Nakanose et al. | 29/423 |
| 4,081,892 | 4/1978 | Mercer | 29/421 |
| 4,706,361 | 11/1987 | Meyer et al. | 29/423 |
| 4,748,837 | 6/1988 | Kurosawa et al. | 72/63 |
| 4,984,348 | 1/1991 | Cadwell | 72/60 |

FOREIGN PATENT DOCUMENTS

| | | | |
|---|---|---|---|
| 2117950 | 10/1972 | Fed. Rep. of Germany | 72/60 |
| 0590163 | 1/1978 | U.S.S.R. | 72/60 |
| 1488099 | 6/1989 | U.S.S.R. | 29/889.7 |

*Primary Examiner*—David Jones

*Attorney, Agent, or Firm*—Dellett, Smith-Hill and Bedell

[57] ABSTRACT

Elevated temperature envelope forming includes enclosing a part blank and form tool within an envelope sealed against the atmosphere, heat treating the combination while forming pressure holds the envelope and part against the form tool, and allowing part cool down to occur in an inert atmosphere with forming pressure removed. The forming pressure is provided by evacuating the envelope and may be aided by differential force applied between the envelope and the form tool.

15 Claims, 8 Drawing Sheets

ELEVATED TEMPERATURE ENVELOPE FORMING

BACKGROUND OF THE INVENTION

The invention described herein was made in the performance of work under a NASA contract NASI-18574 and is subject to the provisions of Section 305 of the National Aeronautics and Space Act of 1948, Public Law 85-568 (72 STAT.435: 42 USC 2457).

The present invention relates to elevated temperature envelope forming and more particularly to a method of forming a skin for airfoils. An aircraft wing surface in flight is characterized by friction between the air and the wing, usually resulting in turbulence and undesired drag. In order to reduce drag and excessive airplane fuel consumption it is desirable to replace turbulence with laminar flow to the extent possible wherein the airflow over a wing surface is relatively smooth. One kind of flow control termed natural laminar flow (NLF) is accomplished through manufacture of precise wing surfaces having a minimum of waviness and roughness. In another method for improved air flow, termed laminar flow control (LFC), the air layer near the surface of the airfoil is drawn through small holes in the airfoil surface with some form of pumping and ducting being used to remove the otherwise turbulent layer through the holes after which the air is vented to the atmosphere away from the airfoil. Still another method combines NLF and LFC to provide hybrid laminar flow control (HLFC) wherein perforations are provided on the leading edge skin of a wing to withdraw an air layer, together with the use of a precision wing surface.

Leading edge wing skins, e.g. as formed of titanium sheet, are typically shaped in a stretch process. However, the provision of perforations in a leading edge skin for laminar flow control is not particularly compatible with stretch forming since stretching tends to elongate preformed holes and distort flow control. The process of creating the perforations in the skin can itself introduce waviness and distortion. Hot forming employing matched dies is not acceptable in the case of preperforated skins because desired waviness tolerance is not easily attained or corrected. Also, contamination from protective coatings normally used in a matched die hot forming process can plug the holes or increase the hole size, e.g. when the coating is removed.

SUMMARY OF THE INVENTION

In accordance with the present invention in a particular embodiment thereof, a process of elevated temperature envelope forming includes placing a perforated sheet metal part blank, which may be preformed to approximately the desired shape, against a form tool, enclosing the part blank and form tool within an envelope, and sealing the envelope against the atmosphere to create a retort. External force is applied to urge the form tool and blank together for constraining the part toward the desired configuration. The retort is evacuated whereby outside air pressure is applied against the envelope, and when the vacuum reaches a sufficient level, the external force is removed and heat treatment is begun. Once the heat treatment is complete, the vacuum within the retort is released and replaced with an inert atmosphere as the retort is allowed to cool.

It is accordingly an object of the present invention to provide an improved method and apparatus for forming a sheet metal part within desired tolerance while preventing contamination of the part's surface.

It is another object of the present invention to provide an improved method and apparatus for forming wing leading edge skins from perforated titanium sheets having a finished waviness tolerance of +/−0.001 inches in two inches.

Another object of the present invention is to provide an improved method and apparatus for thermal processing which reduces the effects of different thermal expansion rates between a part and a forming tool.

It is also an object of the present invention to provide an improved method and apparatus for flattening metal sheets to meet high tolerance requirements.

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements.

DRAWINGS

Figure 4A:
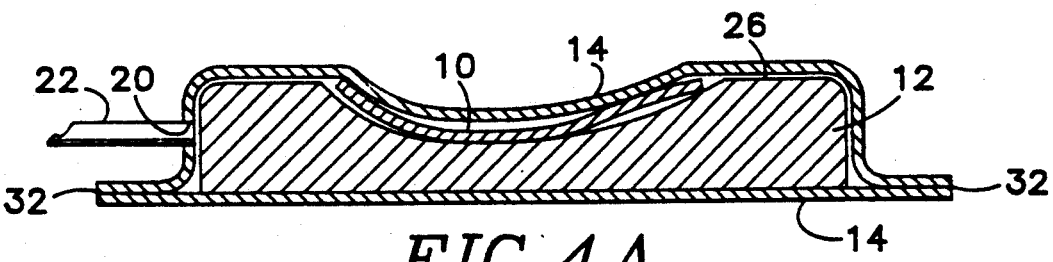
Figure 5:
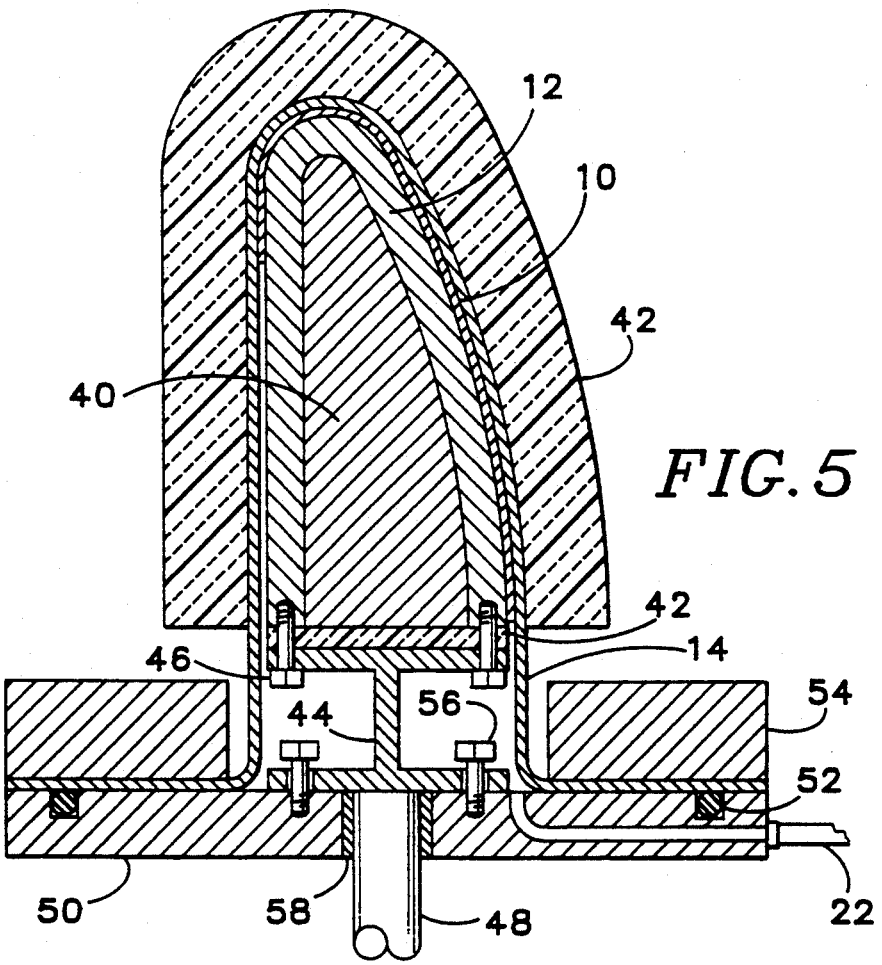
Figure 6:
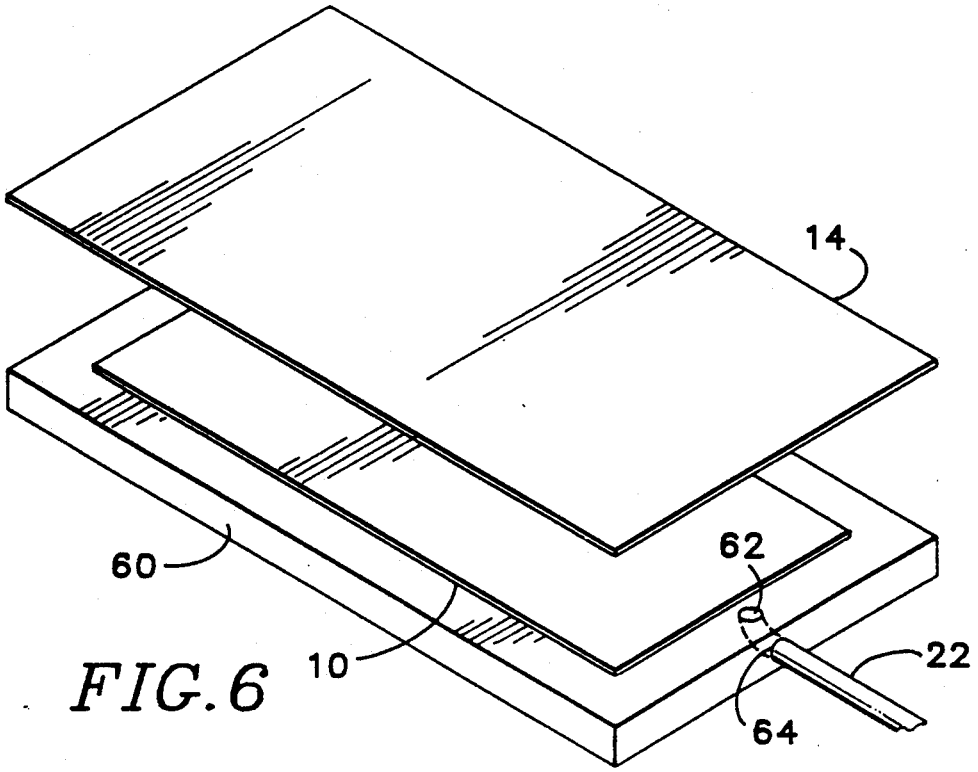
Figure 7:
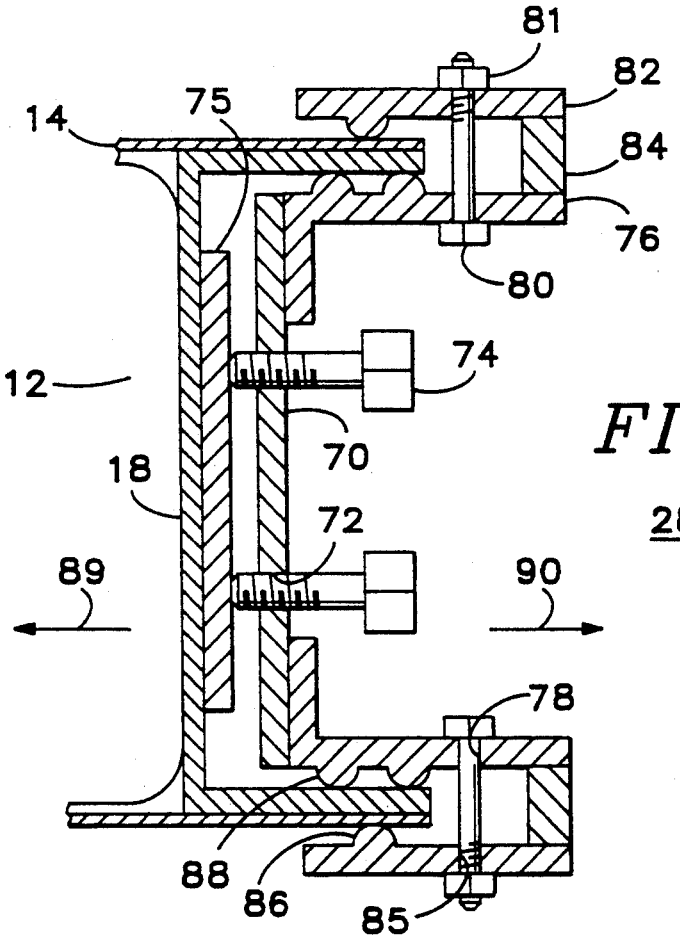
Figure 8:
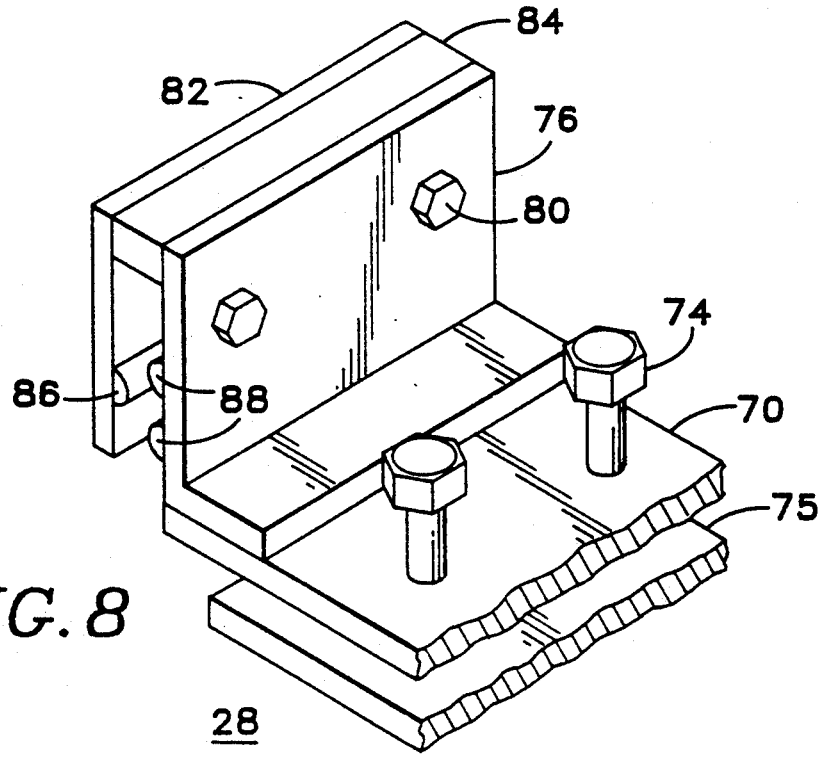
Figure 9:
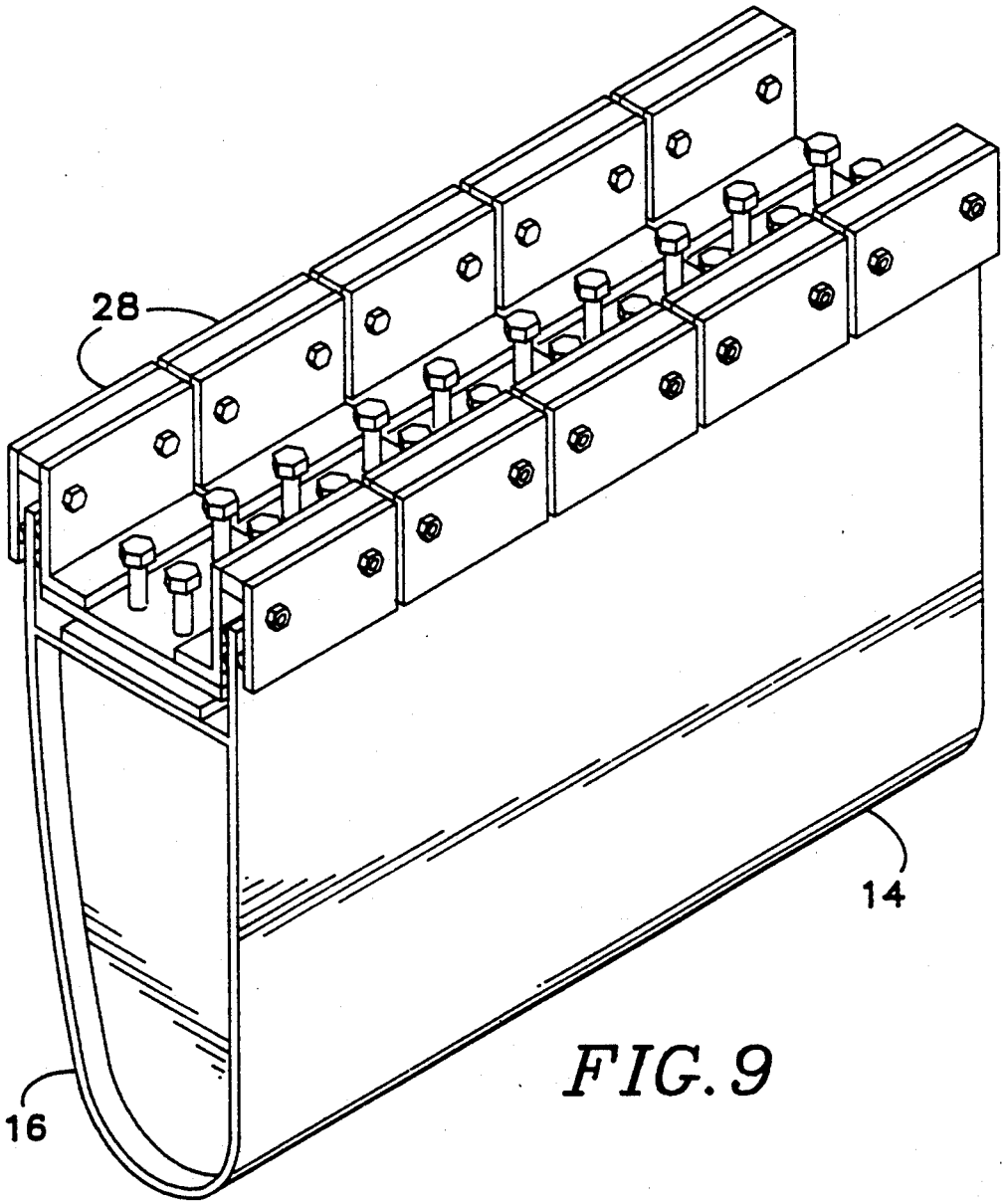
Figure 10:
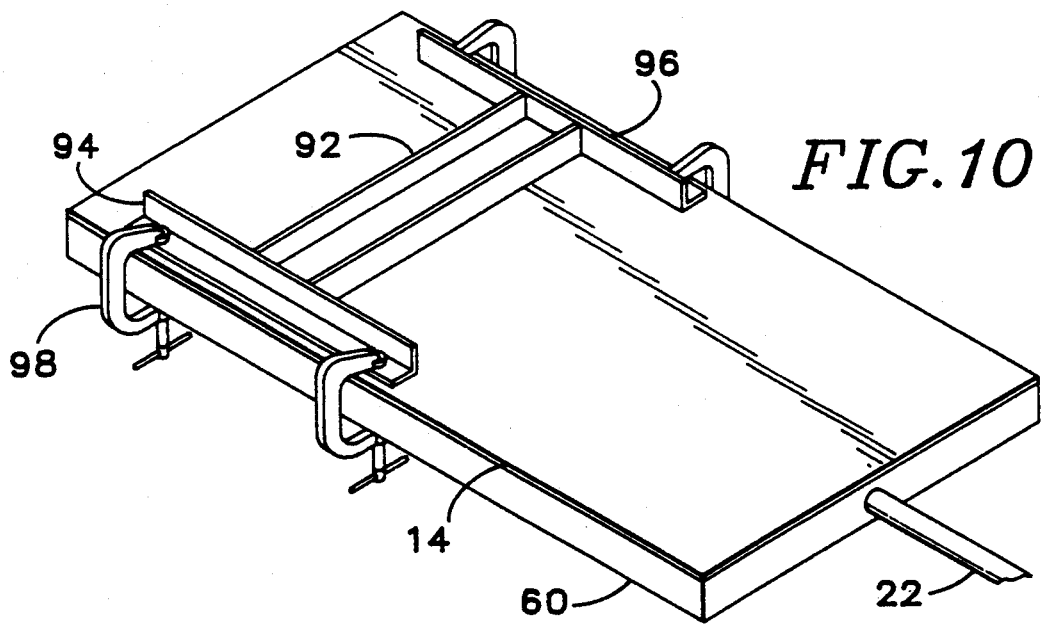

FIGS. 4A and B are cross sectional views of a retort with a female form tool, before and after vacuum is applied;

FIG. 5 is a cross sectional view of an alternate method of envelope forming using an integrally heated forming tool;

FIG. 6 is a perspective view of the present invention applied to sheet metal flattening;

FIG. 7 is a cross sectional view of an assembled retort showing the clamp of FIG. 3 in greater detail;

FIG. 8 is a cut-away perspective view of a portion of the clamp of FIG. 7;

FIG. 9 is a perspective view of an assembled retort with a plurality of clamps attached thereto; and FIG. 10 is a perspective view of a clamping device for holding the envelope tight against a flattening plate during sealing.

DETAILED DESCRIPTION

Figure 1:
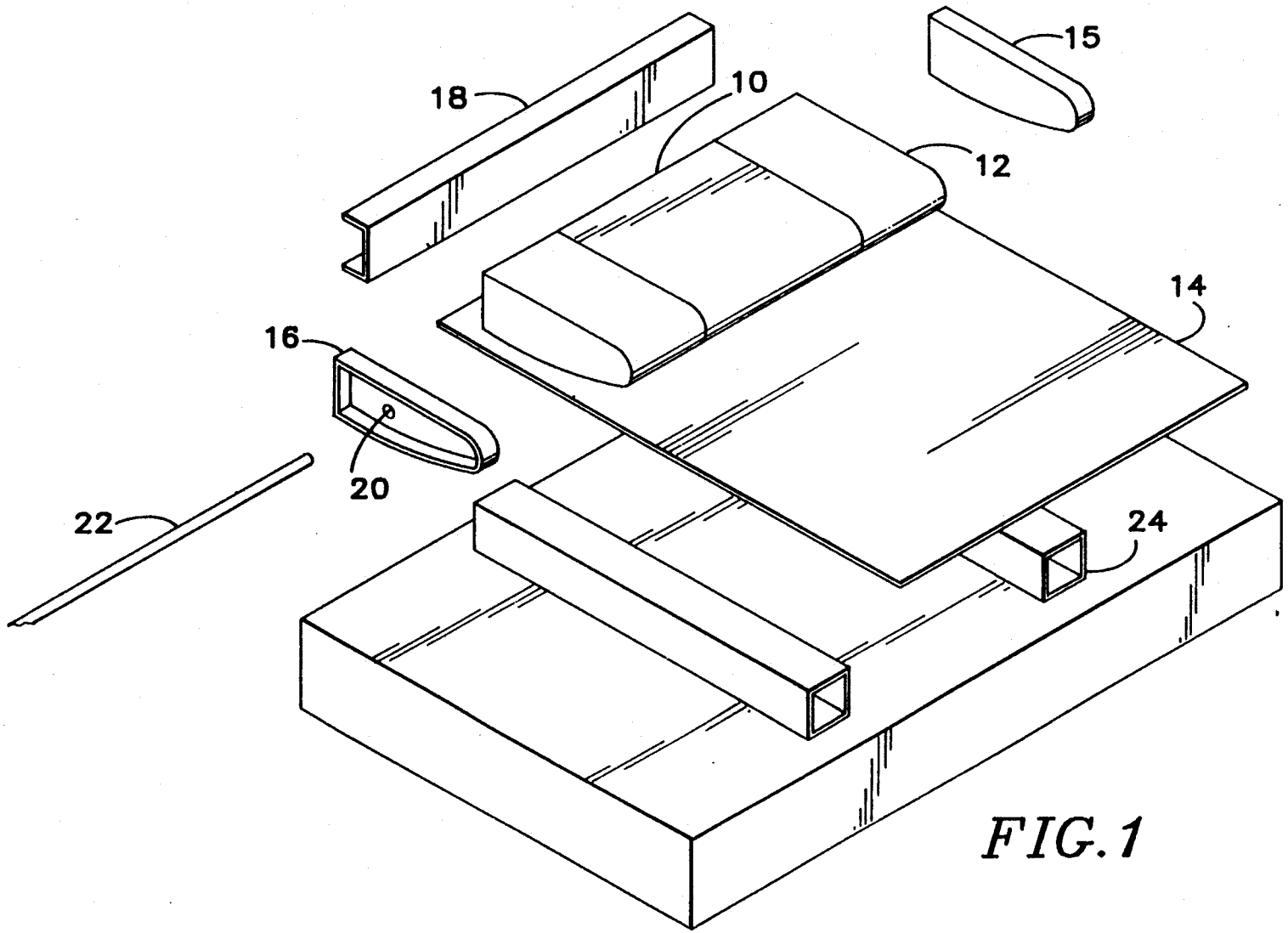
FIG. 1 is an exploded perspective view of a forming retort for a leading edge of an airplane wing.

Referring to FIG. 1 comprising an exploded view of a retort used for forming a desired part, the part 10, which may comprise a perforated sheet of titanium suitable for the leading edge of an airplane wing, is placed against form tool 12 contoured within desired tolerance to the shape which is ultimately desired for the part 10. Form tool 12 is suitably constructed of steel. Once the part is placed over the form tool, an envelope outer skin 14 is wrapped around form 12 and part 10, and end pieces 15 and 16 as well as back channel piece 18 are welded to the envelope skin to provide an atmospheric seal around part 10 and the form tool completing a retort. In the preferred embodiment, envelope skin 14, end pieces 15 and 16 and back piece 18 comprised stainless steel members having a thickness of approximately 0.032 inch, while part 10 comprised titanium sheet having a thickness of 0.040 inch. Stainless steel was chosen as envelope material partly because it does not react with titanium and is relatively clean, i.e., normally free of surface contaminants such as oil, which could contaminate the part.

Figure 2:
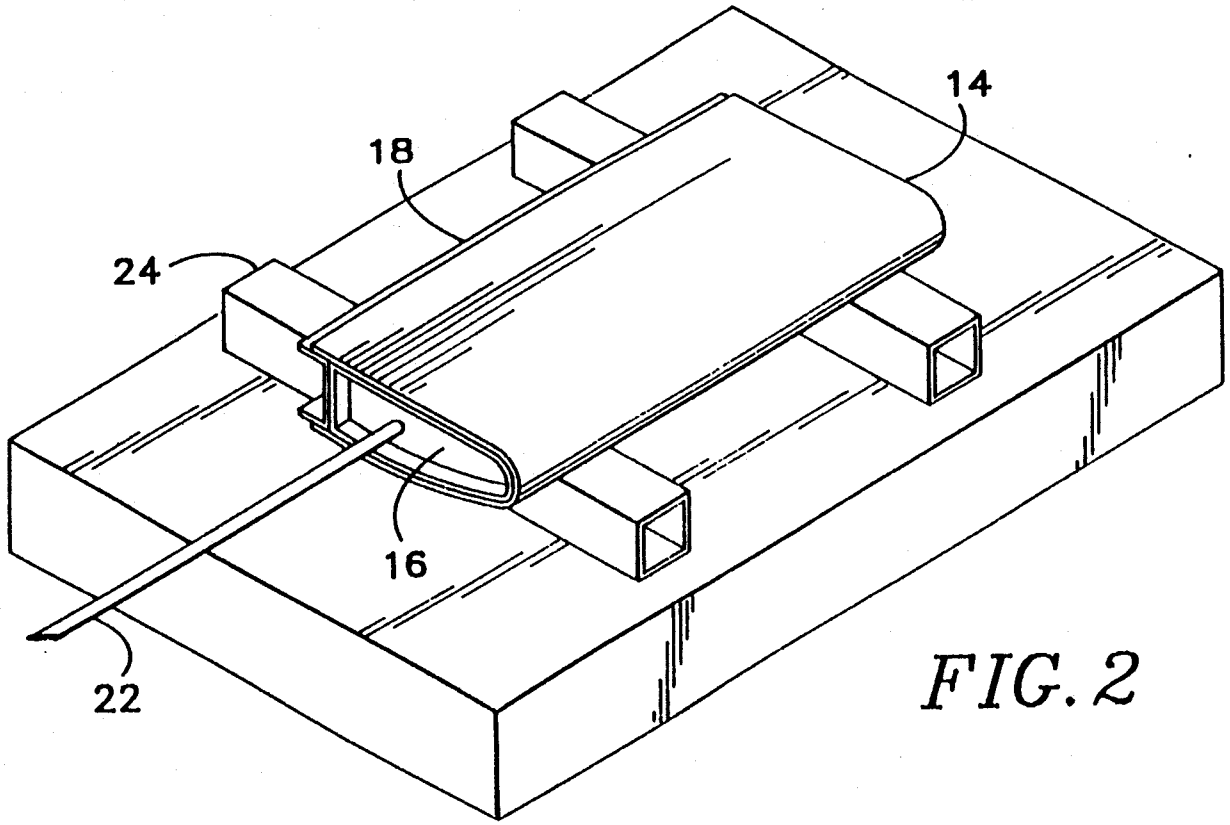
FIG. 2 is a perspective view of the assembled retort of FIG. 1.
Figure 3A:
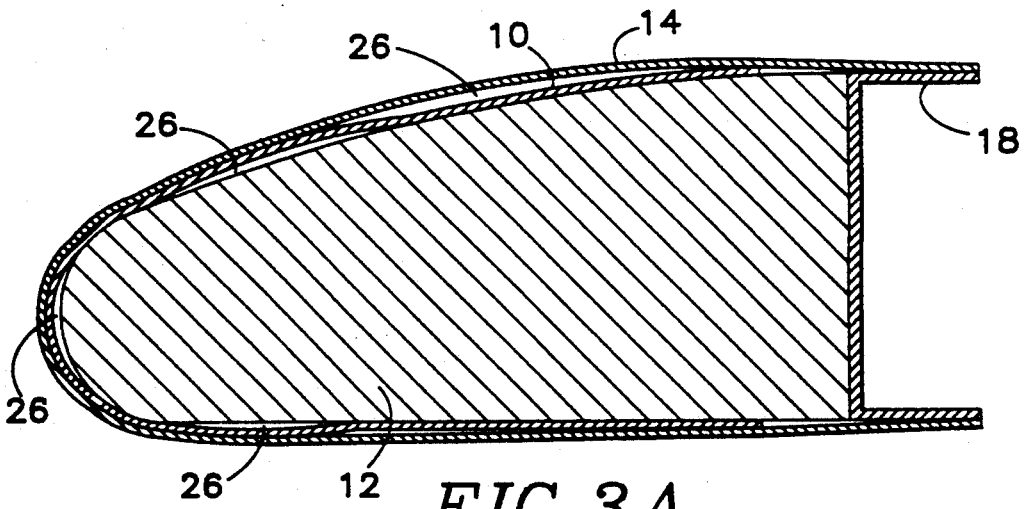
FIGS. 3A–3E are cross sectional views of the forming retort of FIG. 2 for various phases of preparation for heat treatment and thereafter.
Figure 3B:
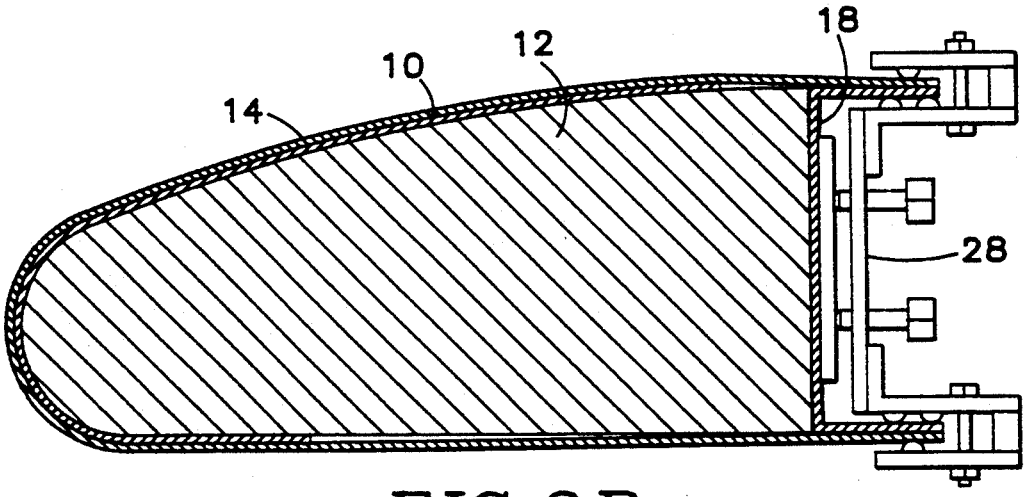
Figure 3C:
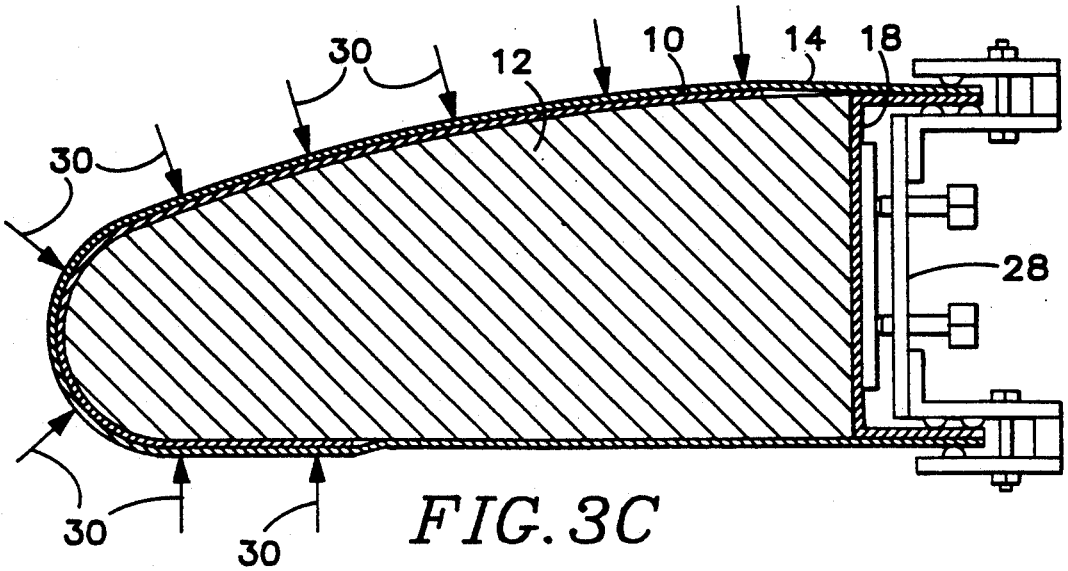
Figure 3D:
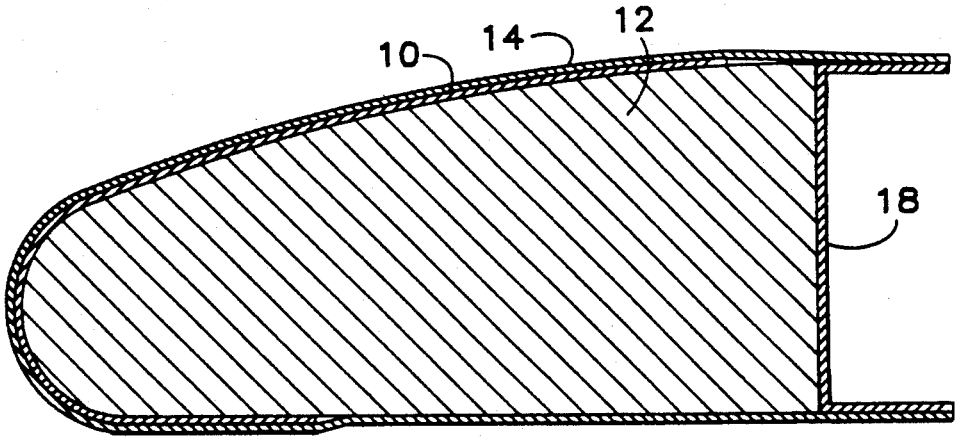
Figure 3E:
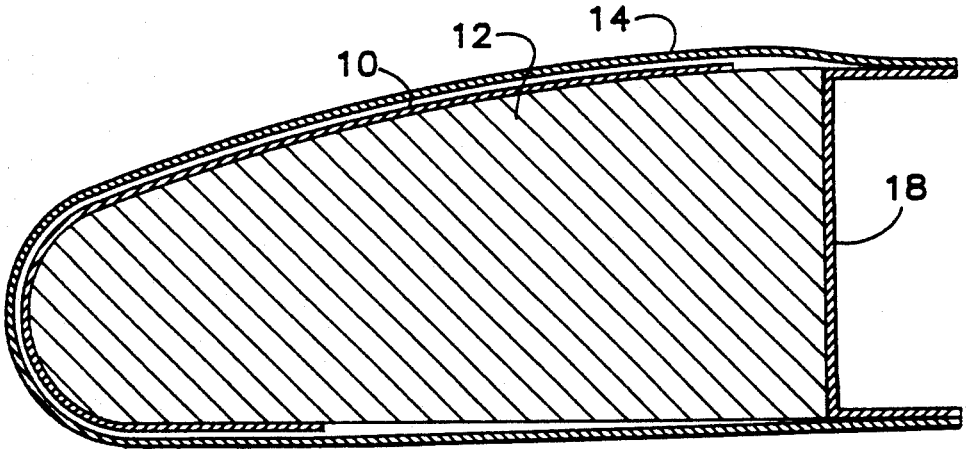

Envelope end 16 is provided with an opening or fitting 20 connected to vacuum/argon supply line 22 for evacuating the atmosphere within the enclosed envelope and for providing an argon atmosphere at appropriate times within the envelope as subsequently discussed herein in connection with FIGS. 3C-3E. Placement of the vacuum supply opening is not critical; it is simply necessary to choose a location that will not result in the vacuum hole becoming plugged during evacuation and heating. Tool support beams 24 are placed below the entire assembly and raise the retort to allow heat circulation underneath. FIG. 2 is a perspective view of the retort after the envelope has been sealed.

After envelope sealing, force is applied to the rear 18 of the retort to push form tool 12 against the envelope, thereby pressing the part 10 against the forming tool. Once this external forming pressure is applied, a vacuum is drawn within the retort via vacuum line 22 and the physical pressure at the rear 18 of the retort is removed since friction between the envelope, part and tool coupled with the vacuum holds the part tightly against the tool. External forming pressure may not always be necessary since the vacuum alone may suffice. However, some tool shapes may be such that when vacuum is first applied a large part surface area may contact the envelope first, trapping air and leaving insufficient envelope pressure against the part. The retort should be constructed to be nearly form fitting to the shape of the form tool since if the retort is not reasonably form fitting, the welded seams can crack after vacuum is applied and allow vacuum leakage. The envelope skin 14 is quite collapsible to adhere closely to the part and the tool.

The entire assembly is then placed within a furnace (while maintaining the vacuum) for heat treatment to relieve residual stresses and insure the part takes on the desired shape. Performing the stress relief under a vacuum is desirable to minimize contamination of the part.

FIG. 3 comprises cross sectional views of the envelope and part forming tool during various stages of the forming operation. FIG. 3A illustrates the envelope before forming pressure has been applied, but after the envelope has been sealed, and it is seen hollow areas 26 may exist at locations where the part 10 is not snug against form tool 12. Referring now to FIG. 3B, forming pressure has been applied wherein clamp assembly 28 is attached to the rear of the envelope 18 and used to force the form tool forwardly within the retort pulling envelope skin 14 more closely against the form tool. The operation of clamp assembly 28 will be discussed subsequently in connection with FIGS. 7-9. Once the clamp force has pulled the envelope skin fairly taut, vacuum pressure is provided via vacuum line 22, not illustrated in FIG. 3, and the external atmospheric pressure adheres the envelope snugly against form tool 12 and the intervening part 10. The effect of external atmospheric pressure against the part and form tool is illustrated by arrows 30 in FIG. 3C. Once the vacuum has been provided, clamp assembly 28 can be removed (FIG. 3D) and the envelope part and tool are ready for heat treatment.

FIG. 7 is a cross sectional view showing clamp 28 of FIG. 3 in greater detail, while FIG. 8 is a cut-away perspective view of a portion of the clamp. Clamp assembly 28 fits behind the retort back channel member 18 of FIGS. 1 and 3, opposite form tool 12, and includes clamp base plate 70 having threaded holes 72 for receiving pusher bolts 74. In the preferred embodiment, the clamp base is provided with four threaded holes 72 evenly spaced in the plane of the base plate so as to distribute pressure from the bolts. The bolts 74 threadably engage the holes, and when tightened, push against pressure plate 75 engaging channel member 18. Clamp base flanges 76, having their front faces attached to the base plate 70 near its perimeter at opposing edges thereof, are provided with openings 78 near the rear of each flange for receiving bolts 80. Clamp top members 82, joined to flanges 76 by outwardly extending spacers 84 to complete a U-shaped cross-section, are arranged to be approximately coextensive with the clamp base flanges and have holes 85 through which bolts 80 extend for receiving nuts 81. Each clamp top member 82 is provided with a gripper seam 86 while clamp base flanges 76 each carry a pair of spaced gripper seams 88 disposed on either side of seam 86. In operation, bolt 80 is passed through flange holes 78 and 85 and nut 81 is threaded onto the bolt. The rear "ears" of the assembled retort (comprising envelope 14 welded to envelope 18) are fed between flange gripper seams 86 and 88 and nuts 81 are tightened. Pusher bolts 74 are then tightened, exerting force on pressure plate 75, causing the pressure plate to push form tool 12 forwardly in the direction of arrow 89, while the clamp assembly (via grippers 86 and 88) is pulling the envelope backwards in the direction of arrow 90. It will be noted channel member 18 can be distorted somewhat. FIG. 9 is a perspective view of an assembled retort having a plurality of clamps 28 attached thereto.

After the vacuum is applied and the clamps are removed, the retort is placed in a furnace for heat treatment. When the heat treatment is completed and the cool down cycle has begun, the pressure holding the part against the form tool should be released to prevent wrinkling of the part as may be caused by the differing rates of thermal expansion of the part and the form tool. According to the present invention it is preferred to release the vacuum and pressurize the envelope with an inert gas, for example, argon, after the heating is finished. This pressure fills the envelope as shown in FIG. 3E and allows the part to freely contract, preventing the part from wrinkling.

The invention allows relatively inexpensive materials to be used as form tools, for example, carbon steel, when forming part metals such as titanium which may not have like thermal expansion rates, ASTM A-36 steel plate being used as form tool material in a particular embodiment. An inert gas is used because it inhibits contamination of the part; in a preferred embodiment, the retort was pressurized to approximately 10 inches $H_2O$ positive pressure with argon gas. Part contamination may be further reduced in the initial portion of the process by purging the retort with the inert gas for a period of time (e.g. 8 hours) before applying the vacuum and heat stress relief. Both thermal expansion and part contamination problems are lessened by using the lowest possible temperature for stress relief. For instance, stress relief treatment may suitably comprise heating the retort to 1,000 degrees Fahrenheit for one hour.

Figure 4B:
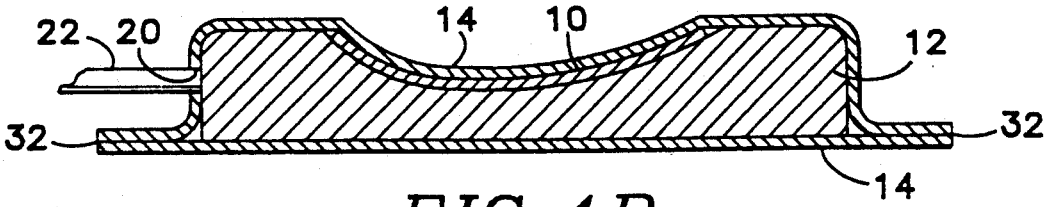

While the foregoing example has illustrated a male form tool, the present invention is also applicable to part forming with a female tool as shown in FIG. 4. In FIG. 4A, part 10 is placed against form tool 12 and surrounded by envelope 14, sealed as by welding at various points indicated by reference numerals 32. Vacuum supply line 22 is provided via orifice 20 to maintain a vacuum within the envelope whereby hollow spaces 26 are removed by external atmospheric pressure against the envelope 14 resulting in the configuration illustrated in FIG. 4B.

FIG. 5 illustrates a cross sectional view of an alternative method of forming parts at elevated temperature. Part 10 is placed around form tool 12, the latter including a heater element 40, empowered by means not shown, contained within the hollow center thereof whereby the necessary heat can be supplied for the stress relief for insuring the part will take on the desired shape. Envelope 14 surrounds the part and tool while insulation 42 is suitably disposed in surrounding relation to the envelope. Insulation may also be included at the base of the form tool where the latter is attached to riser platform 44 by means of bolts 46. Platform 44 is mounted upon an envelope tightener 48 suitably comprising a hydraulically operated rod extending upwardly from a hydraulic cylinder (not shown). Envelope 14 is sealed against the atmosphere by means of underlying base plate 50 upon which platform 44 initially rests, an 0-ring seal 52, and a heavy "picture frame" 54 for pressing the periphery of envelope 14 tightly against base plate 50. Envelope 14 extends continuously from one edge of base plate 50, around the part and form tool, to the opposite edge of the base plate, and is further sealed at either end by means not shown. Vacuum supply 22 is connected through a passage in the base plate for evacuating the envelope during heat forming, and for supplying an inert atmosphere during the cool down period once the vacuum is released.

The maximum range of upward motion of hydraulic tightener 48 is determined by means of shoulder bolts 56 threadably attached to base plate 50 and passing through openings in platform 44 whereby platform 44 may translate only along the length of bolts 56. A seal 58 is provided at the location where rod 48 passes through base plate 50, to insure maintenance of a vacuum in the part forming chamber during the foregoing procedure.

The high density perforation patterns initially created in sheet metal skins used for airplane wing portions in laminar flow control applications can lead to significant distortion of the metal sheet. Furthermore, when the part is first preformed to roughly approximate the desired final shape before final forming, distortion can make the preforming process difficult. It is desirable to at least insure the sheet metal skin is initially planar. Referring to FIG. 6, a flattening plate 60 is provided having a vacuum hole 62 on the upper face thereof, such vacuum hole 62 being connected via an inner passage in plate 60 to vacuum line 22 through fitting 64. The sheet metal part 10, of smaller planar dimension than plate 60, is placed on top of the flattening plate and top sheet 14 typically of the same planar dimension as flattening plate 60 is placed over the part forming a sandwich. The sandwich is sealed to the atmosphere, for example by welding the top sheet to the flattening plate along the perimeter thereof. To ensure the envelope and part 10 fit as snugly as possible against the flattening plate, the envelope and sheet are suitably held against the flattening plate during welding, for example by placing weights on top of the envelope.

In the preferred embodiment, a clamping device was constructed to hold the top sheet and part against the plate during welding. Referring now to FIG. 10, such clamping device comprises a channel member 92 extending substantially across the width of envelope sheet 14 and attached by welding at opposite ends thereof to right angle flanges 94 and 96 adapted to extend along a portion of the perimeter of the envelope in perpendicular relation to channel member 92. Ordinary C-clamps 98 are employed to hold the clamping device firmly against the flattening plate. Once the envelope edges are sealed, the C-clamps and clamping device can be removed. The "sandwich" is placed within a furnace after the atmosphere within the sandwich is evacuated via vacuum tube 22 to pull the top sheet taut for pressing the part against the flattening plate and removing waviness or distortion in the part. The heat treatment insures the part will take on the flat shape of plate 60. When a cooling period subsequently takes place, the vacuum within the envelope is released and the envelope may be provided with an atmosphere of an inert gas, relieving the pressure, and allowing the part to move and accommodate for varying thermal expansion rates. Once cool down has finished, the top sheet is peeled away. In a specific embodiment, top sheet 14 comprised 0.032 inch thick stainless steel, part 10 comprised 0.040 inch thick titanium and flattening plate 60 comprised a flat steel plate one inch in thickness.

While several embodiments of the present invention have been shown and described, it will be apparent to those skilled in the art that many changes and modifications may be made without departing from the invention in its broader aspects. The appended claims are therefore intended to cover all such changes and modifications as fall within the true spirit and scope of the invention.

We claim:

1. A method for forming a sheet metal part comprising the steps of:

placing a part blank against a form tool;

enclosing said part blank and said form tool within a flexible envelope by at least partially wrapping said envelope around said part blank;

sealing said envelope against atmospheric pressure;

providing a vacuum within said envelope for holding said envelope against said part blank in substantially form fitting engagement with said forming tool; and heating said envelope, said part blank and said form tool for a period of time thereby forming the sheet metal part.

2. The method according to claim 1 further including providing differential force between said form tool and said envelope to urge said part against said form tool.

3. The method according to claim 1 further comprising perforating said part blank with a plurality of apertures.

4. The method according to claim 1 further comprising the step of purging the enclosed portion of said envelope with an inert atmosphere for a period of time after said step of sealing said envelope and before providing a vacuum.

5. A method for forming a sheet metal part comprising the steps of:

placing a part blank against a form tool;

enclosing said part blank and said form tool within an envelope;

sealing said envelope against atmospheric pressure;

providing a vacuum within said envelope for holding said envelope against said part blank;

heating said envelope, said part blank and said form tool for a period of time; and replacing said vacuum with an inert atmosphere once the heating period is complete thereby forming the sheet metal part.

6. The method according to claim 5 wherein said step of replacing said vacuum with an inert atmosphere comprises providing Argon.

7. A method for forming a sheet metal part comprising the steps of:

placing a part blank against a form tool;

enclosing said part blank and said form tool within a stainless steel envelope;

sealing said envelope against atmospheric pressure;

providing a vacuum within said envelope for holding said envelope against said part blank; and heating said envelope, said part blank and said form tool for a period of time thereby forming the sheet metal part.

8. A method for forming a sheet metal part comprising the steps of:

preforming a part blank to be approximately the shape of a form tool;

placing said part blank against said form tool;

enclosing said part blank and said form tool within an envelope;

sealing said envelope against atmospheric pressure;

providing a vacuum within said envelope for holding said envelope against said part blank; and heating said envelope, said part blank and said form tool for a period of time thereby forming the sheet metal part.

9. A method for forming a portion of an airfoil to within strict waviness tolerances comprising the steps of:

perforating said portion with a multiplicity of apertures;

placing said airfoil portion around a convexly shaped form tool adapted to provide the final configuration of said portion;

enclosing said airfoil portion and said form tool within an envelope, at least a portion of said envelope having relatively high collapsibility properties;

sealing said envelope against atmospheric pressure;

providing external force inwardly against said convexly shaped form tool relative to edges of said envelope;

providing a vacuum within said envelope for pulling said envelope tightly against said form tool;

removing said external force while maintaining said vacuum; and heating the combination of said envelope, said airfoil portion and said form tool for a period of time.

10. The method according to claim 9 further comprising the step of releasing said vacuum and providing an inert replacement atmosphere after the heating period.

11. Apparatus for forming a sheet metal part comprising:

a forming tool of the shape to which the part is to be formed;

a flexible envelope member for holding said part in substantially form fitting engagement with said forming tool;

means for atmospherically sealing the part against said forming tool to provide an enclosure and for drawing a vacuum therewithin; and means for physically urging the part against said forming tool.

12. Apparatus according to claim 11 wherein said means for physically urging the part comprises hydraulic means.

13. Apparatus for flattening a metal sheet comprising:

a flat plate;

a flexible envelope for enclosing said sheet and at least a portion of said plate for forming a chamber, said sheet being disposed within the chamber between said plate and said envelope;

means for atmospherically sealing said chamber; and means for withdrawing air from said chamber.

14. A method for flattening a metal sheet comprising the steps of:

placing the metal sheet against a flattening plate;

sealing the metal sheet and at least part of the flattening plate within a flexible envelope;

evacuating the envelope; and heating the metal sheet for stress relief while maintaining the evacuated state of said envelope.

15. A method for flattening a metal sheet comprising the steps of:

placing the metal sheet against a flattening plate;

sealing the metal sheet and at least part of the flattening plate within an envelope;

evacuating the envelope;

heating the metal sheet for stress relief; and providing the envelope with an inert atmosphere after heating is completed.

* * * * *